United States Patent [19]

Watson et al.

[11] Patent Number: 4,666,197

[45] Date of Patent: May 19, 1987

[54] BOTTLE HOLDER

[76] Inventors: Wayne R. Watson, 111 Grove St.; Howard E. Morse, 11 Dyer Ave., both of Randolph, Mass. 02368

[21] Appl. No.: 852,979

[22] Filed: Apr. 16, 1986

[51] Int. Cl.[4] ..... B65D 23/10

[52] U.S. Cl. ..... 294/31.2; 294/33; 215/100 A

[58] Field of Search ..... 294/31.2, 33, 32, 27.1, 294/29, 31.1, 87.2, 87.28, 145, 164, 165, 166; 215/100 A, 100 R, 101; 16/114 R, 114 A; 220/85 H, 94 R; 248/311.2, 312, 145.6

[56] References Cited

U.S. PATENT DOCUMENTS 3,086,806 4/1963 McAndrew ..... 294/33

4,379,578 4/1983 Schuler ..... 294/31.2

4,582,215 4/1986 Barrash ..... 294/31.2

*Primary Examiner*—James B. Marbert

*Attorney, Agent, or Firm*—Herbert L. Bello

[57] ABSTRACT

A bottle holder for use with a bottle having a wide body and a narrow neck formed with an annular flange, particularly a soft drink bottle. The bottle holder has a lower annular band which fits snugly over the bottom of the bottle, an upper apertured gripping member which fits over the flange, and a handle which connects the upper gripping member and lower band. The handle is formed with an integral hinge portion which permits the lower band to be folded into the handle to form a flat member for packaging and storage.

16 Claims, 5 Drawing Figures

BOTTLE HOLDER

BACKGROUND OF THE INVENTION

1. Field of the Invention

The invention relates to bottle holding devices and, more particularly, is directed towards a bottle holder for a bottle having a narrow neck and a wide body.

2. Description of the Prior Art

Bottlers of soft drinks have introduced two and three liter plastic bottles. Generally, these bottles have relatively large diameter bodies which are difficult to securely hold when pouring the contents because of their size and because the sides have a tendency to collapse when squeezed. A variety of bottle holders, such as shown in U.S. Pat. Nos. 4,379,578; 4,486,043; and 3,610,671 have been met with varying degrees of success. A need has arisen for an improved bottle holder for large bottles.

SUMMARY OF THE INVENTION

It is an object of the present invention to provide a bottle holder which permits a user to easily pour the contents of a bottle having a relatively large diameter body.

It is another object of the invention to provide a bottle holder which securely engages a plastic bottle having a large diameter body and a narrow neck with an annular flange in order to facilitate pouring of the contents therefrom. The bottle holder has an upper gripping member, an intermediate hinged handle and a lower annular band. The upper gripping member is provided with an aperture that is configured to fit over the top of the bottle and flange. The lower annular band is sized and shaped to slip over the bottom of the bottle and frictionally engage the wide body. The lower band and upper gripping member are connected by a transition member to the intermediate handle. A hinge is provided between the lower end of the handle and the annular band, the hinge permitting the lower band to fold into the handle for shipping and storage. The gripping member is composed of a material which is sufficiently flexible to permit those portions of the gripping member about the aperture to bend as it is pushed over the annular flange in the neck of the bottle. The transition member is composed of a material which is sufficiently flexible to bend slightly when the bottle is lifted by the handle and sufficiently rigid to pull the lower band and upper gripping member towards each other when the bottle is lifted by the handle.

The invention accordingly comprises the devices, together with their parts, elements and interrelationships, that are exemplified in the following disclosure, the scope of which will be indicated in the appended claims.

BRIEF DESCRIPTION OF THE DRAWING

A fuller understand of the nature and objects of the present invention will become apparent upon consideration of the following detailed description taken in connection with the accompanying drawings, wherein.

DETAILED DESCRIPTION OF A PREFERRED EMBODIMENTS

Figure 1:
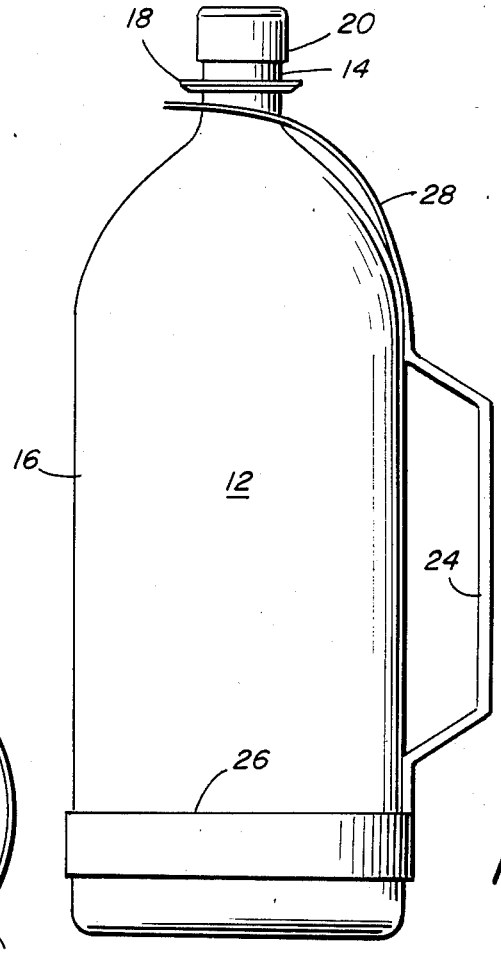
FIG. 1 is a perspective view of a bottle holder embodying the present invention, the bottle holder being attached to a soft drink bottle.

Referring now to the drawings, particularly FIG. 1, there is shown a bottle holder 10 adapted to be used with a bottle 12, the bottom of which tapers inwardly. In the illustrated embodiment, bottle 12 is a large capacity bottle now popular among soft drink manufacturers and usually having a capacity of two or three liters. Typically, bottle 12 has a narrow neck 14 and a wide body portion 16, the body portion having a substantially larger diameter than the neck portion. An annular flange 18 is formed in the neck 14 just below a threaded portion 20 of the bottle 12. Preferably, bottle holder 10 is composed of a plastic such as polypropylene.

Figure 4:
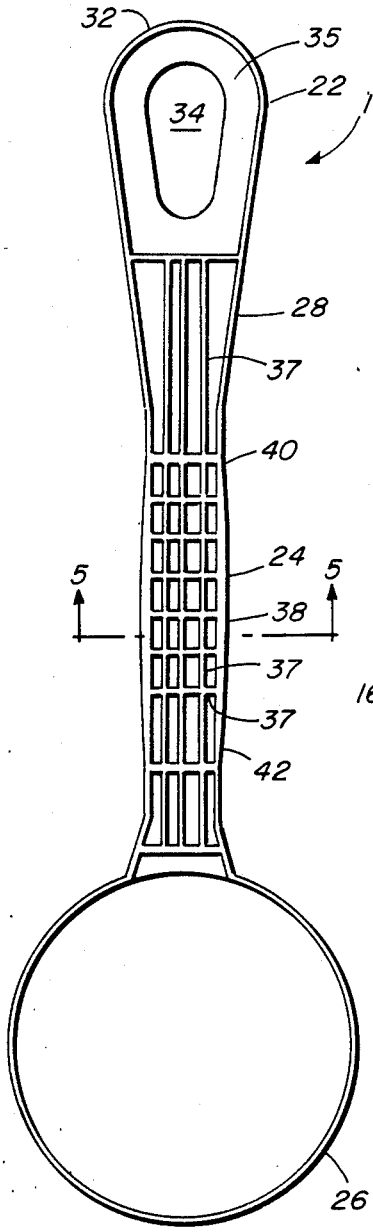
FIG. 4 is a plan view of the bottle holder of FIG. 1.
Figure 3:
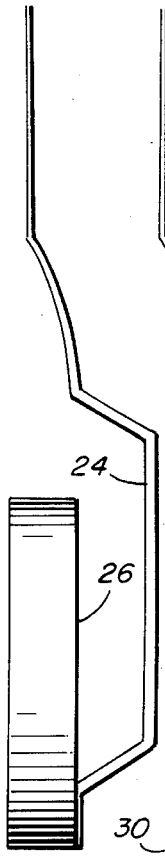
FIG. 3 is a side view of the bottle holder of FIG. 1 with the lower band member in its folded position.

Referring now to FIG. 4, it will be seen that bottle holder 10 has an upper gripping member 22, an intermediate handle 24 and a lower annular band 26. An arcuate transition section 28, which follows the curvature of the transition between neck 14 and body 16, is provided between the upper end of handle 24 and lower end of gripping member 22. As best shown in FIG. 3, a transition member 29 at the lower end of handle 24 is formed with a hinge 30 which permits band 26 to fold into the handle to form a flat structure for shipping and storage. Hinge 30 is formed by reducing the thickness of transition member 29 to permit easy bending at the narrowed portion.

Upper gripping member 22 has a truncated tear drop shape with an enlarged, rounded end 32 at the top of bottle holder 10. The sides of gripping member 22 taper inwardly towards transition member 28 which continues to taper inwardly towards handle 24. Gripping member 22 is formed with an oblong aperture 34, for example a tear drop shaped aperture which generally corresponds to the profile of the gripping member, a track 35 being formed between the forward end and sides of the gripping member and the aperture 34. The major or longitudinal axis of the aperture 34 is larger than the diameter of flange 18 and the minor or lateral axis of the aperture is less than the diameter of flange 18. Gripping member 22 is sufficiently flexible to permit the inner edges of track 35 about aperture 34 to bend in order to allow the gripping member to be pushed over flange 18.

Figure 2:
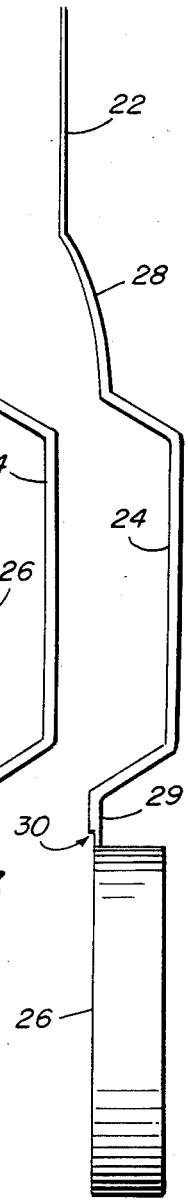
FIG. 2 is a side view of the bottle holder of FIG. 1.
Figure 5:
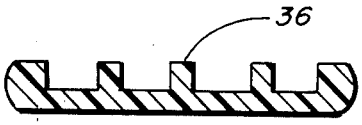
FIG. 5 is a sectional view taken along the line 5—5 in FIG. 4.

Transition member 28 is formed with a plurality of longitudinal ribs 36 and handle 24 is formed with a plurality of longitudinally and laterally disposed ribs 37 for structural integrity and rigidity. The medial portion 38 of handle 24 is slightly larger than the end portions 40, 42 in order to provide a comfortable grip. As shown in FIGS. 1, 2 and 3, the ends of handle 24 are bent inwardly so that the medial portion 38 of the handle is held away from the body 16 of the bottle 12. Transition member 29, which connects the handle 24 and band 26, is formed with integral hinge 30. The hinge 30 bends easily and allows the lower annular band 26 to fold into handle 24 for packaging and storage.

Annular band 26, a strip of plastic material which is formed into a loop, has a diameter which is greater than the diameter of bottle 12 at its lower end and less than the diameter of bottle 12 at its widest point.

The bottle holder 10 is used by first placing aperture 34 over the neck 14 of the bottle 12 and pushing downwardly. As the bottle holder 10 is pushed downwardly of the bottle, gripping member 22 will come to rest upon the top portion of the flange 18 and neck 20 will protrude from aperture 34. In order to lock the gripping member 22 on bottle 12, the user pushes the gripping member downwardly, whereby the flange 18 of the bottle 10 forces the edges of the gripping member about aperture 34 to bend upwardly. The user continues to push downwardly until gripping member 22 is slipped over the flange 18. Then, lower band 26 is pushed onto the bottom of bottle 12 until it is frictionally held about body 16. The distance between the upper end of transition member 28 and hinge 30 is less than the height of bottle 12 so that the bottle holder 10 is held in tension, snugly against the bottle. Transition members 28 and 29 pull slightly away from body 16 of bottle 12 when the bottle is lifted by handle 24, whereby band 26 and gripping member 22 are urged towards each other. In consequence, the gripping action of bottle holder 10 on bottle 12 increases as the bottle is lifted because upper gripping member 22 is pulled downwardly on neck 14 and lower band 26 is pulled upwardly on body 16.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A bottle holder for use with a bottle having a large body and a narrow neck with an annular flange, the bottle tapering inwardly toward its bottom, the bottle holder comprising:

(a) a flexible gripping member formed with an aperture which is sized and shaped to slip over the flange and engage the narrow neck of the bottle below the flange;

(b) a handle, one end of said handle connected to said gripping member;

(c) a flexible annular band connected to the other end of said handle, the diameter of said band being less than the largest diameter of the bottle and greater than the diameter of the bottle at its bottom, said band being sized and shaped to frictionally engage the body of the bottle; and (d) a hinge connecting said band to said handle, said band being movable relative to said handle via said hinge, said band being movable between an extended operative position and a folded storage position against said handle.

2. The bottle holder as claimed in claim 1 wherein said bottle holder is an integral member, said hinge being formed in said integral member, said hinge operative to permit free bending of said band relative to said handle.

3. The bottle holder as claimed in claim 1 wherein said aperture formed in said gripping member has a tear drop shape.

4. The bottle holder as claimed in claim 1 wherein the end portions of said handle are bent inwardly to keep the central portion of said handle away from the bottle when said bottle holder is attached to the bottle.

5. The bottle holder as claimed in claim 1 including a transition member connected between said gripping member and said handle, said transition member pressed against the bottle when said bottle holder is in use, said transition member having a profile which corresponds to the shape of the portion of the bottle against which it is pressed.

6. An integral bottle holder for use with a plastic bottle having a large body and a narrow neck with an annular flange, the bottle tapering inwardly toward its bottom, the bottle holder comprising:

(a) a flexible gripping member formed with an aperture which is sized and shaped to slip onto the narrow neck and over the annular flange of the bottle into engagement with the neck portion below the flange;

(b) a handle, one end of said handle connected to said gripping member;

(c) a flexible annular band connected to the other end of said handle, the diameter of said band being less than the largest diameter of the bottle and greater than the diameter of the bottle at its bottom, said band being sized and shaped to frictionally engage the body of the bottle; and (d) an integral hinge formed in said bottle holder between said band and said handle, said hinge configured to permit free bending of said band relative to said handle, said band hinged for movement relative to said handle between an operative extended position and a folded storage position, said band being foldable against said handle to form a flat structure by bending said band at said hinge.

7. The bottle holder as claimed in claim 6 wherein said aperture formed in said gripping member has a tear drop shape, the longitudinal axis of said aperture being larger than the diameter of the annular flange and the lateral axis of said aperture being smaller than the diameter of the annular flange, the portions of said gripping member about said aperture being sufficiently flexible to bend when said gripping member is pushed onto the bottle and permit said gripping member to fit over the flange and engage the neck portion below the flange.

8. The bottle holder as claimed in claim 7 wherein the end portions of said handle are bent inwardly to keep the central portion of said handle away from the bottle when said bottle holder is attached to the bottle.

9. The bottle holder as claimed in claim 8 including a transition member connected between said gripping member and said handle.

10. The bottle holder as claimed in claim 9 wherein said transition member is bent to conform to the shape of the portion of the bottle against which it is pressed when said bottle holder is attached to the bottle.

11. The bottle holder as claimed in claim 10 wherein the distance between the upper end of said transition member and said hinge is less than the height of the bottle to which said bottle holder is to be attached.

12. The bottle holder as claimed in claim 11 wherein said handle is formed with a plurality of laterally and longitudinally disposed ribs which provide structural integrity and rigidity to said handle.

13. An integral bottle holder for use with a bottle having a large body and a narrow neck with an annular flange, the bottle tapering inwardly at its bottom, said bottle holder comprising:

(a) a flexible gripping member formed with an oblong aperture which is sized and shaped to slip onto the narrow neck and over the annular flange of the bottle, the longitudinal axis of said aperture being smaller than the diameter of the annular flange, the portions of said gripping member about said aperture being sufficiently flexible to bend when said gripping member is pushed onto the bottle and permit said gripping member to fit over the flange and engage the neck below the flange;

(b) a handle, one end of said handle connected to said gripping member, the end portions of said handle being bent inwardly to keep the central portion of said handle away from the bottle when said bottle holder is attached to the bottle;

(c) a flexible annular band connected to the other end of said handle, the diameter of said band being less than the largest diameter of the bottle and greater than the diameter of the bottle at its bottom, said band being sized and shaped to frictionally engage the body of the bottle; and (d) an integral hinge formed in said bottle holder between said band and said handle, said hinge configured to permit free bending of said band relative to said handle, said band hinged for movement relative to said handle between an operative extended position and a folded storage position, said band being foldable against said handle to form a flat structure by bending said band at said hinge.

14. The bottle holder as claimed in claim 13 including a transition member connected between said gripping member and said handle, said transition member being bent to conform to the shape of the portion of the bottle against which it is pressed when said bottle holder is attached to the bottle.

15. The bottle holder as claimed in claim 14 wherein the distance between the upper end of said transition member and said hinge is less than the height of the bottle to which said bottle holder is to be attached.

16. The bottle holder as claimed in claim 15 wherein said handle is formed with a plurality of laterally and longitudinally disposed ribs which provide structural integrity and rigidity to said handle.

* * * * *